United States Patent [19]

Lowry

[11] 4,129,262

[45] Dec. 12, 1978

[54] PULVERIZER HAMMER FOR COMMINUTATING APPARATUS

[75] Inventor: John A. Lowry, Columbus, Ohio

[73] Assignee: E & I Corporation, Columbus, Ohio

[21] Appl. No.: 823,958

[22] Filed: Aug. 12, 1977

[51] Int. Cl.[2] ..... B02C 13/28

[52] U.S. Cl. ..... 241/197; 241/195

[58] Field of Search ..... 241/189 R, 189 A, 195, 241/197

[56] References Cited

U.S. PATENT DOCUMENTS

| | | | |
|---|---|---|---|
| 1,850,244 | 3/1932 | Shelton | 241/195 |
| 1,954,175 | 4/1934 | Jensen | 241/195 |
| 2,763,439 | 9/1956 | Mankoff | 241/197 |
| 3,612,420 | 10/1971 | Hull | 241/197 X |
| 3,805,660 | 4/1974 | Burrough | 241/197 X |
| 3,929,296 | 12/1975 | Stoeber | 241/197 |

FOREIGN PATENT DOCUMENTS

| | | | |
|---|---|---|---|
| 167239 | 2/1934 | Switzerland | 241/195 |

*Primary Examiner*—Howard N. Goldberg
*Attorney, Agent, or Firm*—Mahoney & Stebens

[57] ABSTRACT

A hammer is provided for pulverizing and comminutating apparatus of the hammer mill-type with this hammer including both tearing and shearing edges for enhanced effectiveness in obtaining size reduction of both friable and non-friable materials. This pulverizer hammer includes a relatively narrow tearing edge which is disposed in spaced parallel relationship to the pivot bearing of the hammer. A side edge surface of the hammer associated with that tearing edge is formed in arcuately curved, receding relationship thereto for directing and urging particles of waste material radially outward toward the tearing edge where they will be subjected to further pulverizing action. A shearing edge is also formed along one corner of the side edge surface of the hammer and extends radially in receding relationship to the tearing edge. The arculately curved and contoured surface is also configured to extend in receding relationship with respect to the shearing edge. Both the tearing and shearing edges are preferably provided with a replaceable hard surface coat to substantially extend the operational life. The hammer is also formed with two pivot bearings and four sets of tearing and shearing edges to permit reversible mounting of the hammer as to both end-to-end relationship and as to opposite side edge surface relationship thereby providing four material contacting faces to further extend the effective operational time period before replacement may be required of the hardened surface contact faces.

17 Claims, 6 Drawing Figures

PULVERIZER HAMMER FOR COMMINUTATING APPARATUS

BACKGROUND OF THE INVENTION

Hammer mill-type comminutating or pulverizing apparatus has heretofore been developed and utilized in effecting a size reduction of many types of solid waste materials with attempts at achieving a design for both improved waste disposal and for facilitating reclamination of materials of substantial economic value and capable of being remanufactured. Examples of such materials and operations include the shreading and tearing of large metal objects such as automobile bodies which contain metallic materials that have substantial economic value for remanufacture is reducable to more readily transportable configurations and useable particle size. Other materials subjected to comminutating action of hammer mills include solid waste that may include wood, stone, concrete and brick materials wherein it is advantageous to reduce the sizes of such materials to facilitate their transport to suitable waste disposal sites or further disposal operations. The solid wastes which often include friable materials such as stone and concrete, are best reduced by an impact type action of a pulverizer hammer. However, non-friable materials, such as waste paper and automobile bodies, are more easily reduced by a slicing or shearing action rather than by the blunt force produced by the conventional impact type pulverizer hammers.

Pulverizer apparatus heretofore utilized for such operation generally incorporates hammers that are generally configured as elongated steel bars of rectangular cross-section having a specific width and an edge or surface which forcibly impacts the materials during revolution thereof in a suitable housing provided with breaker bars. A number of these hammers are conventionally mounted on supporting rotor plates and revolved at a relatively high velocity to produce the impacting forces required for pulverization or comminutation of materials of the illustrative types. These rectangular cross-section hammers heretofore employed in such apparatus, in general, only have an impacting edge surface, or leading transverse end edge, which is effective in only providing an impact or tearing type of action with respect to the materials introduced into the pulverizer. These hammers operate in conjunction with a set of transversely disposed breaker bars against which the tearing action is achieved and an impacting force can be applied as a consequence of the logding of a particle of waste material against a breaker bar of the pulverizer housing. This lodging of the particles enables the hammers to be revolved into contacting engagement with the particle or particles to develop an impacting force for the further pulverization thereof.

SUMMARY OF THE INVENTION

A substantially improved hammer is provided by this invention for such pulverizing and comminutating apparatus. The pulverizer hammer of this invention is specifically configured to form both tearing and shearing surfaces or edges to enable the apparatus to more effectively function in reducing the size of waste material particles or objects of any of the various types which are intended to be introduced into equipment of this type. The hammer is provided with both a transversely extending tearing edge surface which bears a more close resemblance to a knife edge rather than the purely angular relationship between an end surface and an edge surface of the prior art bar-type hammers. Additionally, an edge surface of the hammer adjacent to the tearing edge is configured to extend in inwardly receding relationship thereto thereby forming a material guide surface that tends to induce a radial outflow of material toward the tearing edge, as a consequence of the revolution thereof, where a more effective comminuating action may be achieved. Also in accordance with this invention, the pulverizer hammer is formed with a longitudinally extending, shearing edge which projects inwardly from the tearing edge. This shearing edge, in accordance with this invention, is preferably formed along one side surface of the hammer whereby the material guide surface may also be cooperatively configured so as to form a laterally receding surface with respect to the shearing edge and thus provide a relatively narrow shearing edge that is particularly effective in producing a shearing action as to the large metal objects.

These and other objectives and advantages of this invention will be readily apparent from the following detailed description of an illustrative embodiment of the pulverizer hammer and the accompanying drawings.

DESCRIPTION OF THE DRAWING FIGURES

DESCRIPTION OF THE ILLUSTRATIVE EMBODIMENT

Figure 5:
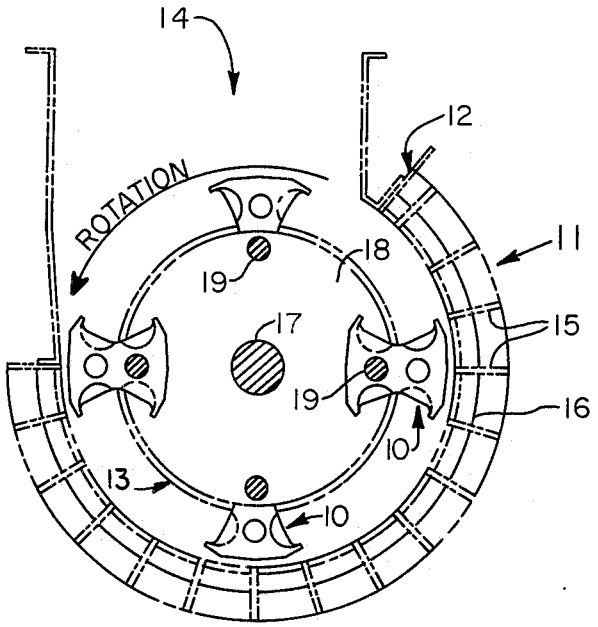
FIG. 5 is a diagrammatic vertical sectional view of a pulverizer apparatus provided with the hammers of this invention.

Having reference to the several figures of the drawings a pulverizer hammer embodying this invention and indicated generally at 10, is shown in FIGS. 1 through 4 for illustration of the specific constructional and configuration details FIG. 5 illustrates functional operation of the hammer in a comminutating apparatus. Referring specifically to FIG. 5, it will be noted that several of the hammers 10 are shown installed in a diagrammatically illustrated hammer mill apparatus 11 for better indicating the utilization and operation of such apparatus. The illustrative hammer mill apparatus 11 includes a pulverizer housing 12 and a hammer supporting rotor 13. This housing 12 is provided with a feed throat 14 through which the materials are introduced into the interior of the housing. Forming the major portion of the illustrative housing 12 are a series of angularly spaced breaker bars 15 which extend parallel to the axis of the rotor. These breaker bars 15 define a cylindrical surface at their inner ends against which the several hammers 10 operate in effecting the pulverizing operations. Additional circularly extending support members 16 are provided to maintain the breaker bars in the illustrated position and provide adequate strength to resist the forces developed during the pulverizing operations.

The several pulverizer hammers 10 are mounted on a supporting rotor structure 13 which includes a central driven shaft 17 and a series of spaced parallel circular plates 18 that are mounted on the shaft 17 in rigidly secured relationship whereby the plates will be driven by that shaft. These circular plates 18 carry the several pulverizer hammers 10 in radially outward relationship to shaft 17 and each of the hammers is pivotally mounted on respective longitudinally extending support shafts 19. In the illustrative installation of FIG. 5, the apparatus is shown as including four hammers 10 that are angularly spaced around a single rotor plate and mounted on the four support shafts 19. It will be understood that a series of such rotor plates 19 are provided on the elongated drive shaft 17 and that additional hammers will be similarly mounted in axially aligned relationship to the illustrated hammers. The number of hammers included in a particular longitudinally extending row is dependent on the size and design capacity of the pulverizer as is the number of hammers that may be positioned in angular relationship with respect to a pair of rotor plates.

As an example of the size apparatus for which the pulverizer hammers 10 of this invention were devised, the circular diameter of the breaker bar surface is of the order of 90 inches with the feed throat 14 being approximately dimensioned to admit the relatively large bodies of waste material such as automobile bodies that may have been previously crushed to a relatively reduced size. It will also be apparent that the length of the apparatus will be proportionately dimensioned to accommodate waste material objects of this size. With this type of apparatus, the hammers have a radially extending dimension of the order of twenty inches and a width of about five and one-half inches. As indicated, these dimensions are provided by way of example to illustrate utilization of pulverizer hammers of this invention and are not considered limitative on the scope of this invention. It will be readily apparent that the size of the hammers as well as the apparatus in which they are installed may be varied in accordance with the specific operational requirements while retaining the advantageous functional operations of the novel pulverizer hammer.

Figure 1:
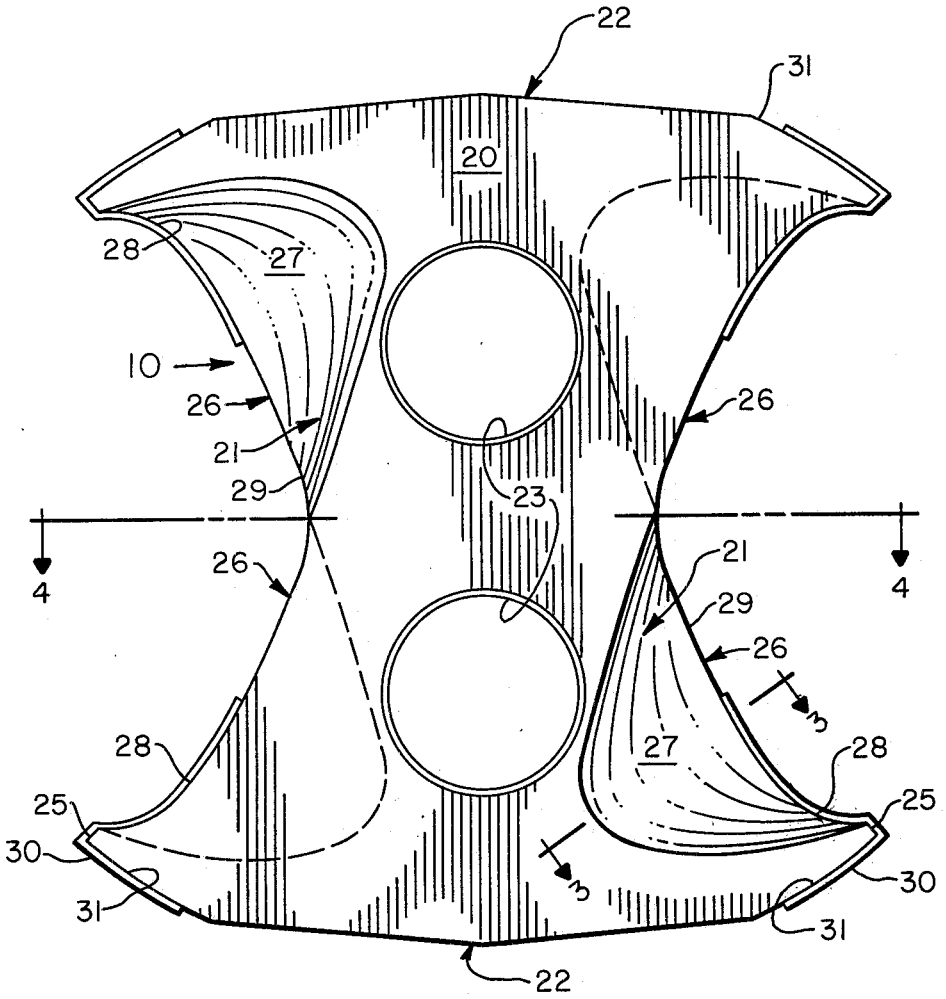
FIG. 1 is a side-elevational view showing a side surface of a pulverizer hammer embodying this invention.
Figure 6:
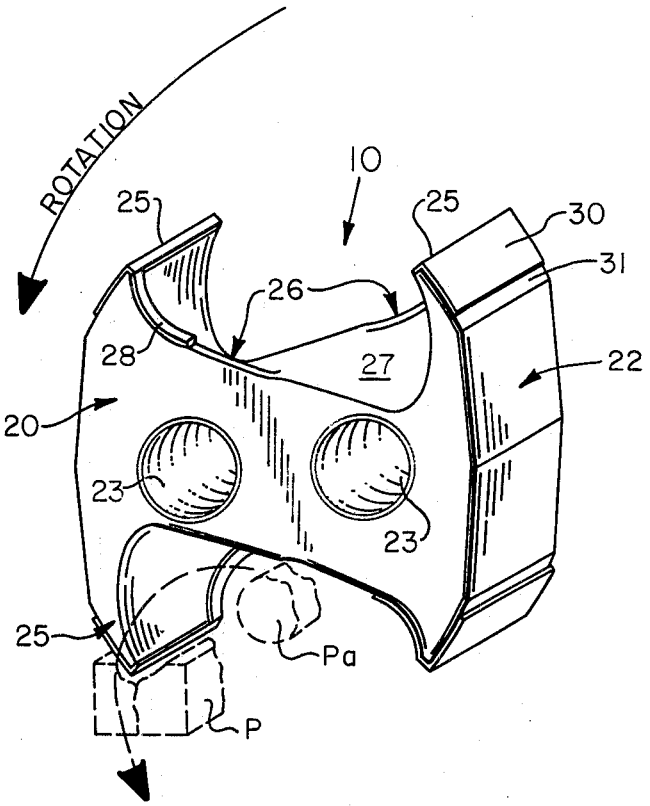
FIG. 6 is a perspective view of a pulverizer hammer embodying this invention and shown in operational relationship to items of waste material being subjected to a pulverizing action.
Figure 2:
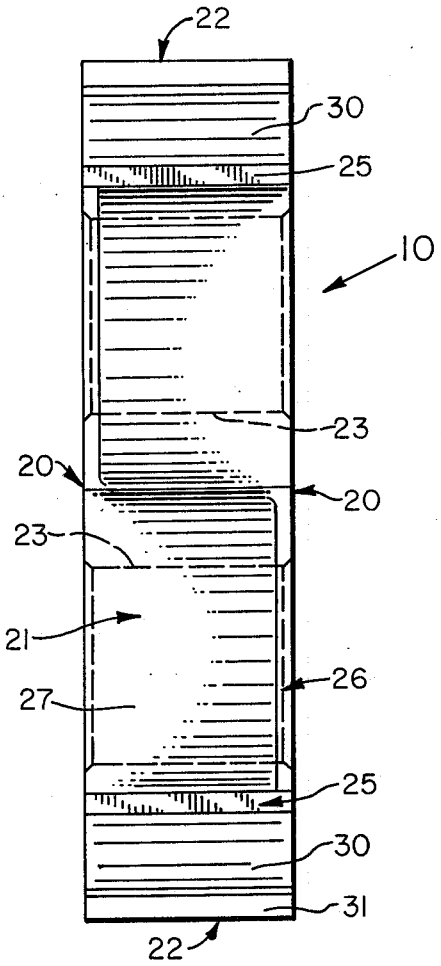
FIG. 2 is an edge elevational view thereof as seen at the right side of FIG. 1.
Figure 3:
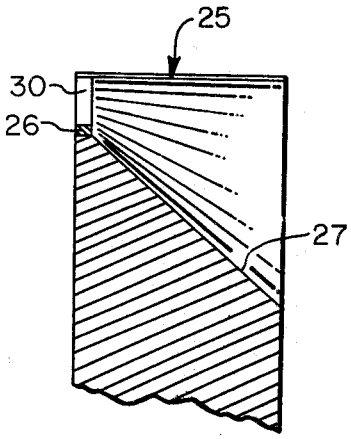
FIG. 3 is a fragmentary transverse sectional view taken along lines 3—3 of FIG. 1.

The specific construction and configuration of the pulverizer hammer 10 is best illustrated in FIGS. 1 through 4 with the FIG. 6 providing a better representation of the general overall appearance. This hammer can be best described as including an elongated body portion and integrally formed head portion with each comprising about one-half of the longitudinal length of the hammer, or the vertiacl heigth as seen in FIGS. 1 and 2. Referring to FIG. 1, it will be noted that the body portion in general comprises either the upper or lower half of the structure as shown in that figure since the hammer is designed for reversible mounting in an end-to-end relationship. It will also be understood that a reference to the head portion is interchangeable in the same manner as to either the upper or lower end as seen in the drawings. Each of these two portions which are thus interchangeable in function in accordance with the mounting include opposed planar side surfaces 20, longitudinal edge surfaces 21 and end surfaces 22. Each hammer is also provided with two transversely extending bearings 23 which are open ended apertures disposed in spaced relatively spaced relationship about a longitudinal axis of the hammer in equidistant relationship to the center. The bearing apertures 23 are adapted to receive the support shaft 19 of the rotor 13.

Figure 4:
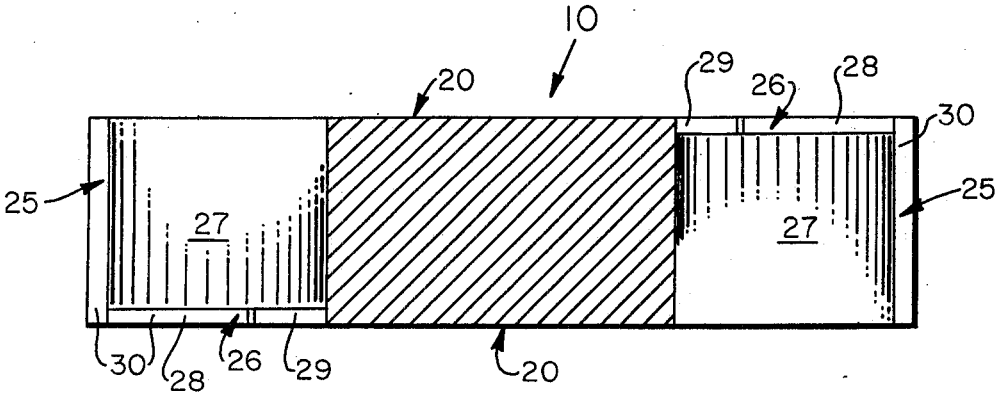
FIG. 4 is a horizontal sectional view taken along line 4—4 of FIG. 1.

Considering next the configuration of the head portion, it will be noted that each end of the hammer is similarly configured and that both edge surfaces 21 are provided with the similarly shaped but of oppositely directed configuration. For purposes of description, reference will be made to the lower right hand portion of the hammer as seen in FIG. 1. This edge surface of the head portion is provided with a tearing edge 25, a shearing edge 26 and a material guide surface 27. The tearing edge 25 is of a relatively narrow shape extending parallel to the axis of the bearing 23 and extends completely across the edge surface 21 of the hammer. The shearing edge 26 is also a relatively narrow surface and extends radially inward with respect to the tearing edge as well as in receding relationship thereto. This edge includes a relatively sharply curved portion 28 immediately adjacent the tearing edge 25 with this edge then terminating in a substantially linear edge 29 that extends approximately to the center of the hammer, or at the approximate juncture of the body and head portion. The guide surface 27, as can be best seen in FIG. 3, recedes from the shearing edge 26 with the angular relationship at its approximate mid-point of the FIG. 3 section plane being an angle which is of the order of 40° with respect to the tearing edge 25. This is the maximum angle of inclination and it will be noted that the guide surface 27 then curves smoothly into alignment with the tearing edge 25 and transverse axis of the hammer. It will also be noted that the ratio of the shearing edge width to the tearing edge length is preferably of the order of one-tenth, as is best shown in FIG. 4, to achieve optimum performance. This configuration of the shearing edge and tearing edge 26 and 25, results in a shape which is effective in both performing the impacting force for pulverizing friable materials but also forms a cutting edge that can effectively slice through other materials that are non-friable.

To further enchance the durability and wearability of the hammer and thus maintain the continued operation to prolong the time period between interchange of the operative edge portions of the hammer, the tearing and shearing edges 25 and 26 are both preferably provided with a hardened surface plating 30. This surface plating which may be readily applied by suitable welding techniques, comprises the deposition of a layer of metal that is much harder than the hammers body or head portions and which is better able to resist the extremely abrasive wearing forces that are encountered in an apparatus such as this nature. This plating 30 covers the outer surface of the tearing edge 25 as well as about one-half of the shearing 26. While the hardened plate does not extend onto the guide surface 27 nor on the side surfaces 20 of the head portion, it is preferred that the plating extend a distance over a portion 31 of the outer end surface 22.

The pulverizing operations that can be effectively accomplished with the pulverizer hammer 10 of this invention are diagrammatically illustrated in FIG. 6. In that figure, the hammer is shown positioned in operative relationship to particle P that is in contacting engagement with the tearing edge 25. It will be readily seen that the particle of material P will be resisted in rotational movement by the breaker bars 15 of the pulverizer housing will thus be subjected to a very high impact force. This impact force is particularly multiplied through the relatively narrow contacting surface of the tearing edge and thus is much more readily fractured and reduced in size to much smaller particles.

While the effect of the shearing edge 26 is not specifically illustrated, it will be readily understood that the shearing edge clearly functions as a radially extending knife in slicing through particles that have a larger dimension than that illustrated but which are otherwise enclosed within the pulverizer housing. This housing provides the necessary resistance to revolution of the particles and thus enables the hammer to function in slicing through articles of this type. This configuration of shearing and tearing edges in conjunction with the material guide surface is also particularly advantageous in that it is self-sharpening and better able to retain the desired profile even if the hard plate 30 is worn through.

One other important advantage of the configuration for the hammer of this invention is the provision of the guide surface 27 as related to both the tearing and shearing edges. This guide surface 27 is configured so that it will tend to cause particles of material to move radially outward toward the outermost ends of the hammer and against the breaker bars. This induced motion of a particle Pa is diagrammatically indicated in FIG. 6 and thus places those particles that may be in the region of the edge surface 21 in the line of operation as to either the tearing edge 25 for further impact or where they may be engaged by the shearing edge 26 at a more radially outward position for a further slicing or shearing operation.

It will be readily apparent from the foregoing description of the illustrative embodiment, that a particularly novel pulverizer hammer is provided by this invention. This hammer is formed with a specifically configured edge surface that includes separate and distinct tearing and shearing edges that are respectively disposed in transversely and longitudinally oriented relationship to the longitudinal axis of the hammer. These tearing and shearing edges are relatively narrow to better concentrate the impacting forces for greater effectivity on both a small surface and at the most radially outward position. The weight of the hammer is also better concentrated at a radially outward position with respect to a bearing for the hammer and a uniquely configured guide surface is formed in conjunction with the tearing and shearing edges to induce radial outflow of material along the edge surface of the hammer to a more effective operating area.

Having thus described this invention, what is claimed is:

1. A pulverizer hammer comprising
(A) an elongated body portion having a longitudinal axis and a shaft receiving bearing extending transversely therethrough at one end, and
(B) a head portion formed with said body portion in relatively remote relationship to said bearing and including
(1) an elongated, transversely extending tearing edge projecting in a generally lateral direction to said longitudinal axis,
(2) a longitudinally extending shearing edge extending in receding relationship to said tearing edge in a direction inwardly relative to said tearing edge, and
(3) a material guide surface extending in receding relationship from said tearing edge in a direction inwardly thereof toward said body portion and in receding relationship laterally from said shearing edge for inducing displacement of material longitudinally outward toward said tearing edge, said guide surface receding from said tearing and shearing edges along a path having a maximum angle of inclination with respect to a plane passing through the axis of said bearing at a point displaced radially inward from said tearing edge toward said bearing.

2. A pulverizer hammer according to claim 1 wherein said shearing edge is disposed to extend from an end of said tearing edge.

3. A pulverizer hammer according to claim 1 wherein said shearing edge is arcuately curved.

4. A pulverizer hammer according to claim 1 wherein said shearing edge is of a width of the order of one-tenth of the length of said tearing edge.

5. A pulverizing hammer according to claim 1 wherein said tearing edge is disposed parallel to the axis of said bearing.

6. A pulverizer hammer according to claim 5 wherein said guide surface terminates along a line extending parallel to the axis of said bearing.

7. A pulverizer hammer according to claim 6 wherein the maximum angle of inclination of said guide surface is disposed at about the midpoint between said tearing edge and the line of termination.

8. A pulverizer hammer according to claim 6 wherein the maximum angle of inclination is less than 45°.

9. A pulverizer hammer according to claim 1 wherein said head portion has an arcuately curved surface portion extending from a radially outward side of said tearing edge.

10. A pulverizer hammer according to claim 9 wherein said tearing edge is disposed parallel to the axis of said bearing and said arcuately curved surface portion is a cylindrical surface section.

11. A pulverizer hammer according to claim 10 wherein said shearing edge and tearing edge are provided with a hardened surface wearing plate.

12. A pulverizer hammer according to claim 11 wherein said cylindrical surface section is provided with a hardened surface wearing plate.

13. A pulverizer hammer according to claim 10 wherein said shearing and tearing edges have a finite width.

14. A pulverizer hammer according to claim 1 wherein said head portion includes a second tearing edge, shearing edge and associated material guide surface disposed in oppositely directed relationship to the first mentioned tearing edge, shearing edge and guide surface.

15. A pulverizer hammer according to claim 14 wherein said body portion is configured identically to said head portion and said head portion is provided with a shaft receiving bearing.

16. A pulverizer hammer according to claim 1 wherein said head portion includes a second tearing edge and associated material guide surface disposed in oppositely directed relationship to the first mentioned tearing edge and guide surface.

17. A pulverizer hammer according to claim 16 wherein said body portion is configured identically to said head portion and said head portion is provided with a shaft receiving bearing.

* * * * *